US005689984A

United States Patent [19]

Diculescu et al.

[11] Patent Number: 5,689,984

[45] Date of Patent: Nov. 25, 1997

[54] SECURITY LOCK SYSTEM

[76] Inventors: Sorin Diculescu; Margaret Ellis, both of 1420 Atlantic Shores Blvd., Apt. 324, Hallandale, Fla. 33009

[21] Appl. No.: 641,219

[22] Filed: Apr. 30, 1996

Related U.S. Application Data

[63] Continuation-in-part of Ser. No. 360,164, Dec. 20, 1994, abandoned.

[51] Int. Cl.[6] ..... E05B 13/00

[52] U.S. Cl. ..... 70/416; 70/214; 70/450

[58] Field of Search ..... 70/416, 450, 452, 70/431, 432, 134, DIG. 58, DIG. 73, 150, 214

[56] References Cited

U.S. PATENT DOCUMENTS

| | | | |
|---|---|---|---|
| 1,367,698 | 2/1921 | Halpen | 70/DIG. 73 |
| 2,497,189 | 2/1950 | Shaffer | 70/450 |
| 4,575,141 | 3/1986 | Burns | 70/214 |
| 4,838,057 | 6/1989 | Schwend | 70/214 |
| 4,947,663 | 8/1990 | Yeager | 70/416 |
| 5,072,976 | 12/1991 | Meszaros | 292/150 |
| 5,369,971 | 12/1994 | Sheppard | 70/452 |

FOREIGN PATENT DOCUMENTS

| | | | |
|---|---|---|---|
| 51625 | 4/1890 | Germany | 292/146 |

*Primary Examiner*—Rodney M. Lindsey
*Assistant Examiner*—Gary Estremsky

[57] ABSTRACT

A security locking assembly comprises a face plate locatable upon a dead bolt lock having a turn knob and a C-shaped component. The face plate has first and second apertures extending through it above and below the turn knob. A planar member with a circular hole is affixed to the face plate and extends within the dead bolt lock opposite from the turn knob. The C-shaped component includes a first horizontal bar, a second horizontal bar and a vertical bar. Each horizontal bar has an inboard end and an outboard end. The vertical bar includes an upper end, a lower end and a center point. The first and second horizontal bars are pivotally coupled in a generally perpendicular orientation to the upper and lower ends of the vertical bar, respectively. The vertical bar is pivotally coupled to the planar member by a hinge pin coupled through the aligned central hole of the vertical bar and circular hole of the planar member. The outboard extent of the first and second horizontal bars extend through the apertures of the face plate adjacent to the turn knob.

1 Claim, 6 Drawing Sheets

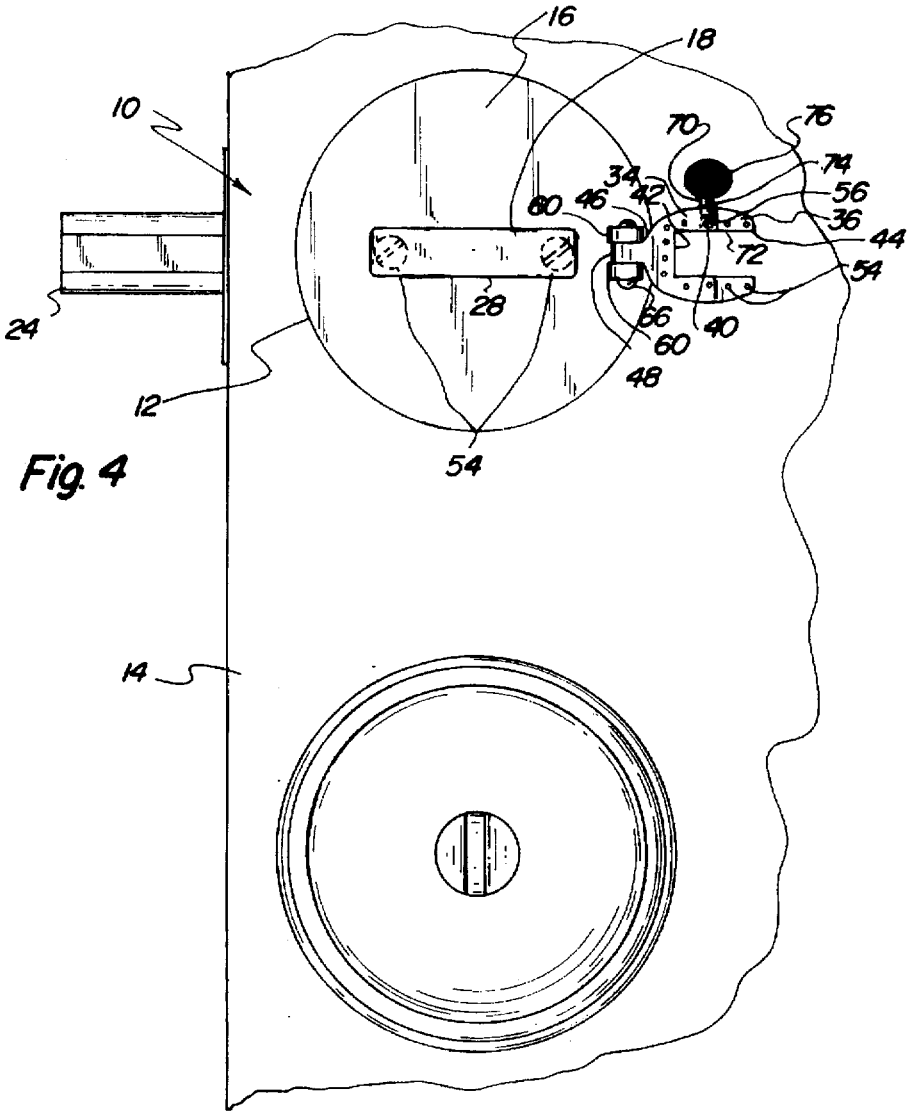
Fig. 4
Fig. 5
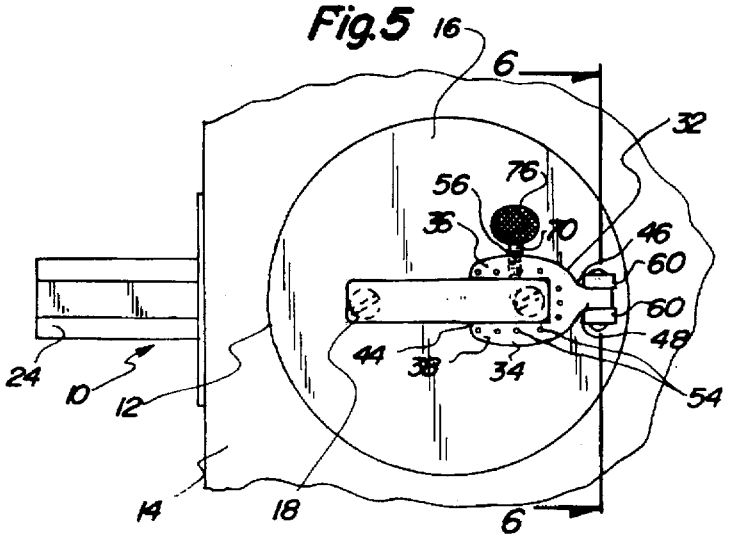

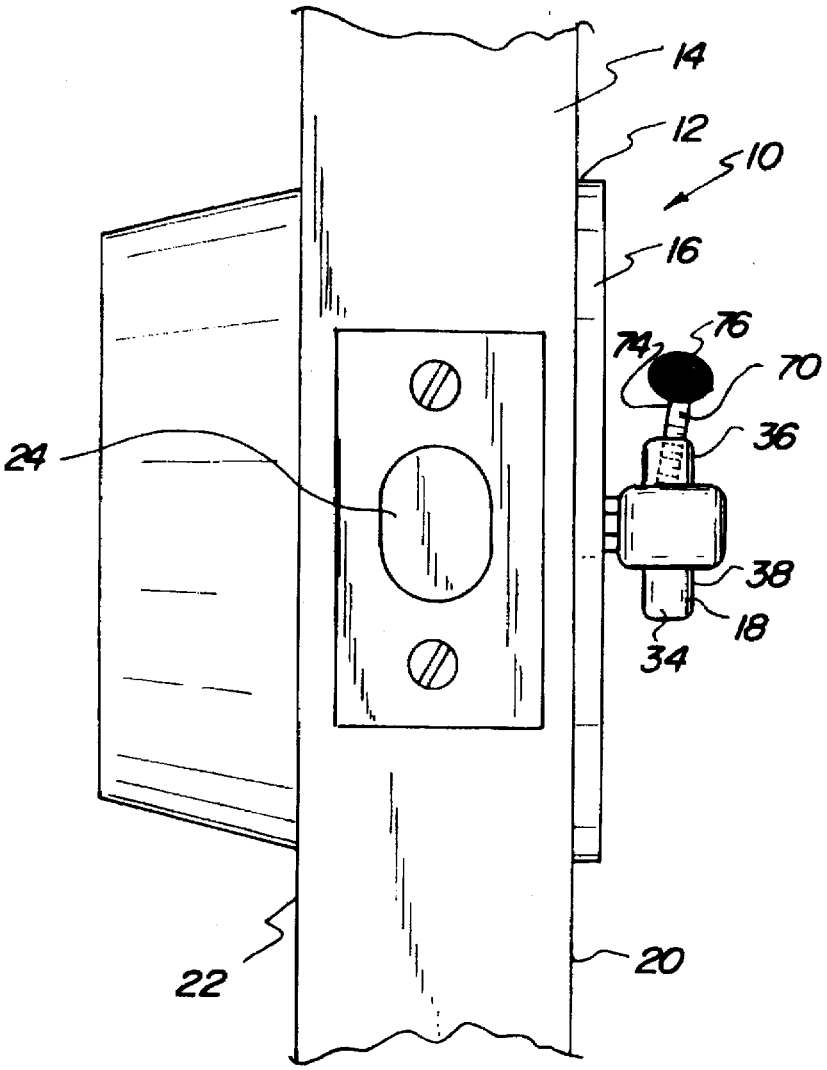
Fig. 6
Fig. 7
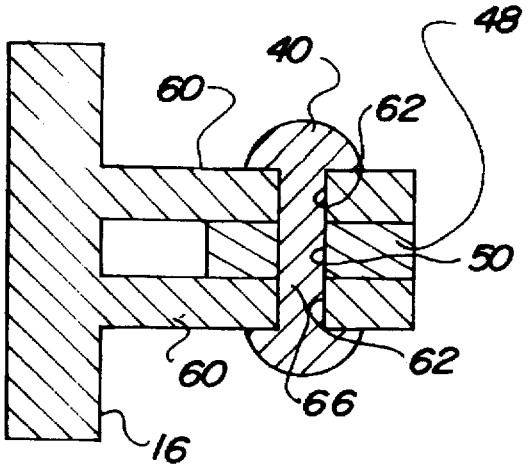

SECURITY LOCK SYSTEM

RELATED APPLICATION

This application is a continuation-in-part of U.S. patent application Ser. No. 08/360,164 filed Dec. 20, 1994, now abandoned.

BACKGROUND OF THE INVENTION

1. Field of the Invention

The present invention relates to a security lock system and, more particularly, to precluding the rotation of a turn knob of a dead bolt lock from the exterior side of a door through a locking assembly with a swinging bar component selectively positionable into or out of locking contact with the turn knob.

2. Description of the Prior Art

The use of locks of a wide variety of designs and configurations is known in the prior art. More specifically, locks of a wide variety of designs and configurations heretofore devised and utilized for the purpose of locking doors are known to consist basically of familiar, expected, and obvious structural configurations, notwithstanding the large number of designs encompassed by the crowded prior art which has been developed for the fulfillment of countless objectives and requirements.

By way of example, the prior art in U.S. Pat. No. 3,423,974 discloses an auxiliary door lock. The auxiliary door lock apparatus appears to be of an extended size for effecting a coupling between a dead bolt and a door knob.

U.S. Pat. No. 5,000,498 discloses an interior dead bolt knob fastening apparatus. The fastening mechanisms appear to require a defacing of the door to install and the use of a screwdriver to lock.

U.S. Pat. No. 5,035,128 discloses an anti-rotation lock apparatus for inside dead bolt locks. The lock apparatus appears to have a large cumbersome device requiring gravity for positioning and a wedging-like action for securement.

U.S. Pat. No. 5,072,976 discloses a locking accessory. The hardware for the accessory appears to necessitate modification of the internal mechanisms of the dead bolt.

U.S. Pat. No. 5,077,992 discloses a door lock set with a simultaneously retractable dead bolt and latch. The set appears to require utilization of plural lock elements on a common door with complex mechanisms therebetween.

U.S. Pat. No. Des. 334,703 discloses the design of a dead bolt knob and doorknob engaging security unit. The operating mechanisms appear to require an elongated member coupling both the dead bolt and the door knob.

A brochure from Quoforum International, Ltd. discloses a dead bolt security device. The operating mechanisms appear to require an elongated member coupling both the dead bolt and the door knob.

U.S. Pat. No. 5,052,202 to Murphy discloses a deadbolt locking device.

U.S. Pat. No. 2,568,081 to McKay discloses a key retaining device.

U.S. Pat. No. 4,715,200 to Katsaros discloses a locking device for a door lock.

U.S. Pat. No. 4,974,663 to Yeager discloses a security device for dead bolt door lock.

U.S. Pat. No. 4,951,982 to Sorkilmo discloses a door lock security apparatus.

U.S. Pat. No. 5,313,812 to Eklund discloses a door lock security system.

U.S. Pat. No. 5,421,074 to Moore discloses a pick proof deadbolt conversion kit.

U.S. Pat. No. 5,035,128 to Ridgeway discloses an anti-rotation lock apparatus for inside deadbolt locks.

U.S. Pat. No. 5,072,976 to Meszaros discloses a locking accessory.

U.S. Pat. No. 5,077,992 to Su discloses a door lock set with simultaneously retractable deadbolt and latch.

In this respect, the security lock system according to the present invention substantially departs from the conventional concepts and designs of the prior art, and in doing so provides an apparatus primarily developed for the purpose of precluding the rotation of a turn knob of a dead bolt lock from the exterior side of a door through a locking assembly with a swinging bar component selectively positionable into or out of locking contact with the turn knob.

Therefore, it can be appreciated that there exists a continuing need for a new and improved security lock system which can be used for the purpose of precluding the rotation of a turn knob of a dead bolt lock from the exterior side of a door through a locking assembly with a swinging bar component selectively positionable into or out of locking contact with the turn knob. In this regard, the present invention substantially fulfills this need.

SUMMARY OF THE INVENTION

In view of the disadvantages inherent in the known types of locks now present in the prior art, the present invention provides an improved security lock system. As such, the general purpose of the present invention, which will be described subsequently in greater detail, is to provide a new and improved security lock system and method which has all the advantages of the prior art and none of the disadvantages.

To attain this, the present invention essentially comprises a new and improved security lock system comprising, in combination, a conventional dead bolt lock in combination with a novel locking assembly as described hereinafter. The dead bolt lock is positionable in a door. Such lock includes a face plate and a rotatable turn knob to lock and unlock the door. The face plate and turn knob are conventional components of standard dead bolt locks and are located on the inside surface of a door with a door knob beneath the dead bolt. The face plate is simply the conventional outer surface of the conventional dead bolt. The dead bolt lock may normally be locked and unlocked through a keyhole in the outside surface of the door. The dead bolt lock is of the type having a dead bolt operable in response to rotation of the turn knob on the inside of the door or in response to a key from the outside of the door. The turn knob extends outwardly from the interior surface of the door and the face plate. The face plate has a first aperture extending through it above the turn knob, and a second aperture extending through it below the turn knob. A planar member is affixed to the face plate and extends within the dead bolt lock opposite from the turn knob. The planar member includes a circular hole extending through it. The turn knob is formed with an exterior surface having an upper planar side edge and a lower planar side edge. Such edges are positionable in a generally horizontal position when the turn knob is rotated into a locked position. The side edges are positionable in a generally vertical orientation when the turn knob is rotated into an unlocked position. The rotational orientation of the edges may vary by 90 degrees in some dead bolt locks. A generally C-shaped component includes a first horizontal bar and a second horizontal bar. Each bar has an inboard end and an outboard end. The inboard end of each bar includes a circular hole extending through it. A vertical bar includes an upper end, a lower end and a center point. The center point and each end of the vertical bar includes a circular hole extending through it. The first and second horizontal bars are pivotally coupled in a generally perpendicular orientation to the upper and lower ends of the vertical bar, respectively, by pivot pins coupled through the aligned circular holes of the horizontal and vertical bars. The vertical bar is pivotally coupled to the planar member by a pivot pin coupled through the aligned central hole of the vertical bar and circular hole of the planar member. The outboard extent of the first and second horizontal bars extend through the apertures of the face plate adjacent to the turn knob. When the turn knob is positioned in a locked orientation a user depresses the outboard end of the second horizontal bar thereby causing the second horizontal bar to pivot inwardly. This action causes the first horizontal bar to pivot outwardly above the turn knob thereby precluding rotation of the turn knob. To permit rotation of the turn knob to an unlocked orientation a user depresses the outboard end of the first horizontal bar thereby causing the first horizontal bar to pivot inwardly and the second horizontal bar to pivot outwardly below the turn knob. The turn bar may then be rotated in a counter clockwise direction without obstruction by the first horizontal bar.

In a first alternative embodiment of the apparatus a dead bolt lock is positionable in a door with a face plate and rotatable turn knob located on the inside surface of the door. The system has a dead bolt operable in response to rotation of the turn knob. The turn knob extends outwardly from the interior surface of the door and the face plate. The turn knob is formed with an exterior surface having upper and lower planar side edges positionable in a first orientation when the turn knob is rotated into a locked position and positionable in a second orientation when the turn knob is rotated into an unlocked position. A horseshoe-shaped bar component has a first bar and a second bar with interior edges parallel with respect to each other and an interior vertical edge coupled between the upper and lower edges. The edges form an opened exterior end and a closed interior end. The interior end has thereadjacent a coupling bridge functioning as a pivot pin. The first and second legs are formed with a plurality of holes with horizontal axes extending therethrough for weight reduction. The first bar is formed with a generally vertically extended threaded aperture. A projection is secured with respect to the face plate and extends outwardly from the face plate at a horizontal elevation corresponding to the turn knob when in the first locked position. The projection is positioned on the face plate. The hinge pin extends through an aperture of the projection to create a pivot point for the rotation of the horseshoe-shaped bar component between the opened and closed positions. A thumb piece is provided which has at its first end a threaded exterior surface and at its second end a grasping member. The thumb piece is positionable in a first orientation with its threaded end rotatably secured within a mating threaded aperture of the bar component to contact and hold the turn knob locked. The thumb piece is positionable in a second orientation with its threaded end out of contact with the turn knob to allow rotation of the bar component away from the turn knob and allow unlocking of the turn knob.

In a second alternate embodiment, the invention comprises a security locking assembly including a face plate locatable upon a dead bolt lock having a turn knob. A bar component is provided and has at least one bar with an interior edge. A hinge pin is coupled as an extension of the bar component with a projection secured with respect to the face plate and receiving the hinge pin to create a pivot point for the rotation of the bar component between an opened position remote from the turn knob and a closed position adjacent to the turn knob. Also provided is a thumb piece which has at its first end a threaded exterior surface and at its second end a grasping member. The thumb piece is in a generally vertical position with its threaded end rotatably secured within a mating threaded aperture of the bar component adapted to move with respect to the turn knob to preclude its rotation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, assemblies, systems and methods for carrying out the several purposes of the present invention. It is important, therefore, that the claims be regarded as including such equivalent constructions insofar as they do not depart from the spirit and scope of the present invention.

It is therefore an object of the present invention to provide a new and improved security lock system which has all the advantages of the prior art locks of a wide variety of designs and configurations and none of the disadvantages.

It is another object of the present invention to provide a new and improved security lock system which may be easily and efficiently manufactured, maintained, utilized and marketed.

It is another object of the present invention to provide a new and improved security lock system which is of durable and reliable construction.

It is another object of the present invention to provide a new and improved security lock system which is susceptible of a low cost of manufacture with regard to both materials and labor, and which accordingly is then susceptible of low prices of sale to the consuming public, thereby making such security lock system economically available to the buying public.

It is another object of the present invention to provide a new and improved security lock system which provides in the apparatuses and methods of the prior art some of the advantages thereof, while simultaneously overcoming some of the disadvantages normally associated therewith.

It is another object of the present invention to preclude the rotation of a turn knob of a dead bolt lock from the exterior side of a door through a locking assembly with a horseshoe-shaped swinging bar component selectively positionable in contact with the turn knob.

It is another object of the invention to simplify the operation of security lock systems so they will be used more regularly.

It is another object of the invention to improve security for homes, offices and other facilities.

It is another object of the present invention to provide a security locking system comprising a security locking assembly comprising: a face plate locatable upon a dead bolt lock having a turn knob; a bar component having at least one bar with an interior edge; and a hinge pin pivotally coupling the bar component with respect to the face plate for rotation of the bar component. The face plate has a first aperture extending therethrough above the turn knob, the face plate having a second aperture extending therethrough below the turn knob, a planar member with a circular hole being affixed to the face plate and extending within the dead bolt lock opposite from the turn knob, and wherein the bar component is formed in a generally C-shaped configuration including a first horizontal bar and a second horizontal bar, each bar having an inboard end and an outboard end, a vertical bar including an upper end, a lower end and a center point, the first and second horizontal bars being pivotally coupled in a generally perpendicular orientation to the upper and lower ends of the vertical bar, respectively, the vertical bar being pivotally coupled to the planar member by a hinge pin coupled through the aligned central hole of the vertical bar and circular hole of the planar member, the outboard extent of the first and second horizontal bars extending through the apertures of the face plate adjacent to the turn knob, with the turn knob in a locked orientation a user depressing the outboard end of the second horizontal bar thereby causing the second horizontal bar to pivot inwardly and the first horizontal bar to pivot outwardly above the turn knob thereby precluding rotation of the turn knob, a user depressing the outboard end of the first horizontal bar thereby causing the first horizontal bar to pivot inwardly and the second horizontal bar to pivot outwardly below the turn knob thereby permitting rotation of the turn knob to an unlocked orientation.

It is another object of the present invention to provide a security locking system comprising: a face plate locatable upon a dead bolt lock having a turn knob; a bar component having at least one bar with an interior edge; and a hinge pin pivotally coupling the bar component with respect to the face plate for rotation of the bar component. The bar component is formed in a horseshoe-shaped configuration, each bar having interior horizontal edges generally parallel with respect to each other, a vertical bar being coupled between the first and second bars, the interior horizontal edges and vertical bar forming an opened exterior end and a closed interior end including a central horizontal extension member, the first and second bars being formed with a plurality of holes with horizontal axes extending therethrough for weight reduction, the first bar being formed with a generally vertically extended threaded aperture.

It is another object of the present invention to provide a security locking assembly. The security locking assembly comprises a face plate locatable upon a dead bolt lock having a turn knob. A bar component is provided and has at least one bar with an interior edge. A hinge pin is coupled as an extension of the bar component with a projection secured with respect to the face plate and receiving the hinge pin to create a pivot point for the rotation of the bar component between an opened position remote from the turn knob and a closed position adjacent to the turn knob. A thumb piece is provided which has at its first end a threaded exterior surface and at its second end a grasping member. The thumb piece is positionable in a first orientation with its threaded end rotatably secured within a mating threaded aperture of the bar component to contact and hold the turn knob locked. The thumb piece is positionable in a second orientation with its threaded end out of contact with the turn knob to allow rotation of the bar component away from the turn knob and allow unlocking of the turn knob.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a front elevational view of a first alternative embodiment of the new and improved security lock system constructed in accordance with the principles of the present invention.

FIG. 5 is a front elevational view of the system shown in FIG. 4 but with the horseshoe-shaped bar component in the locking position.

FIG. 6 is a side elevational view of the system shown in FIGS. 4 and 5 taken along line 6—6 of FIG. 5.

FIG. 7 is a cross-sectional view taken through the hinge pin of FIGS. 4 and 5.

The same reference numerals refer to the same parts through the various Figures.

DESCRIPTION OF THE PREFERRED EMBODIMENT

Figure 1:
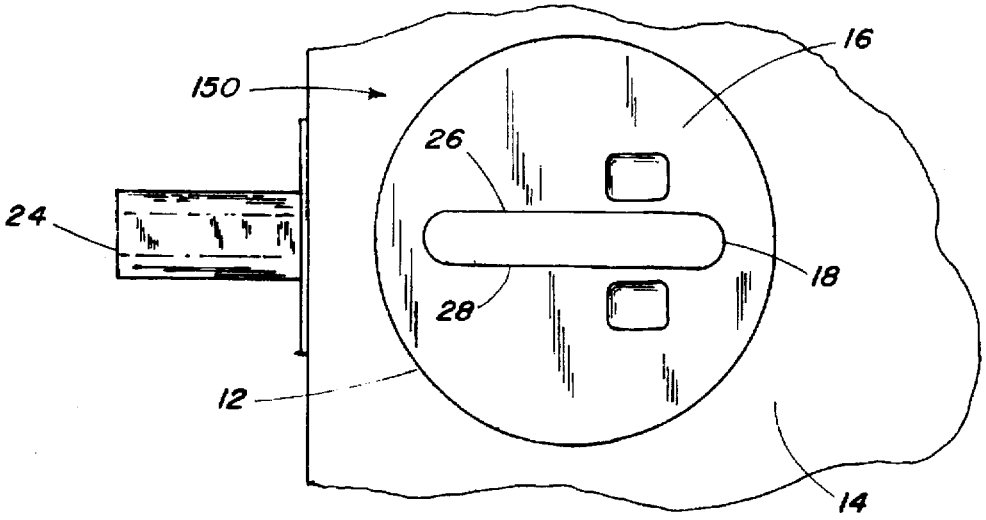
FIG. 1 is a front elevational view of the preferred embodiment of the new and improved security lock system constructed in accordance with the principles of the present invention.
Figure 3:
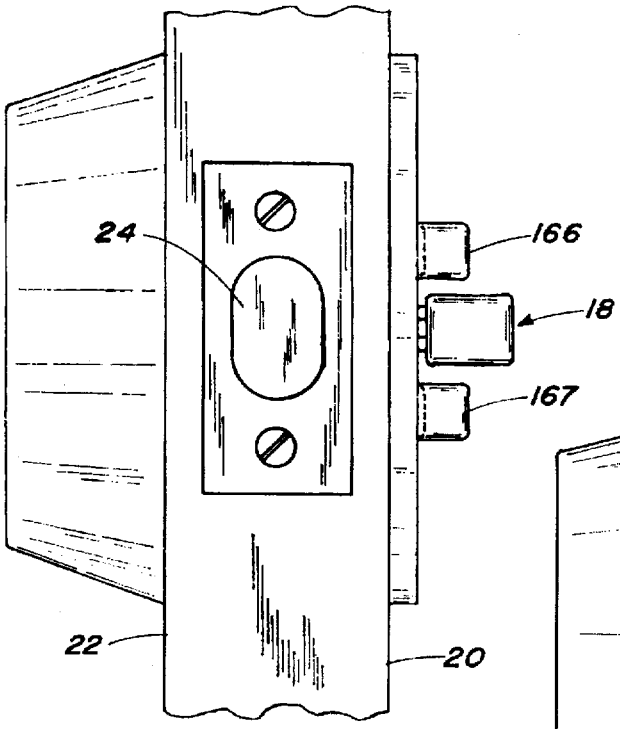
FIG. 3 is a side cross sectional view of the system shown in FIG. 2 illustrating the configuration of the C-shaped component.
Figure 2:
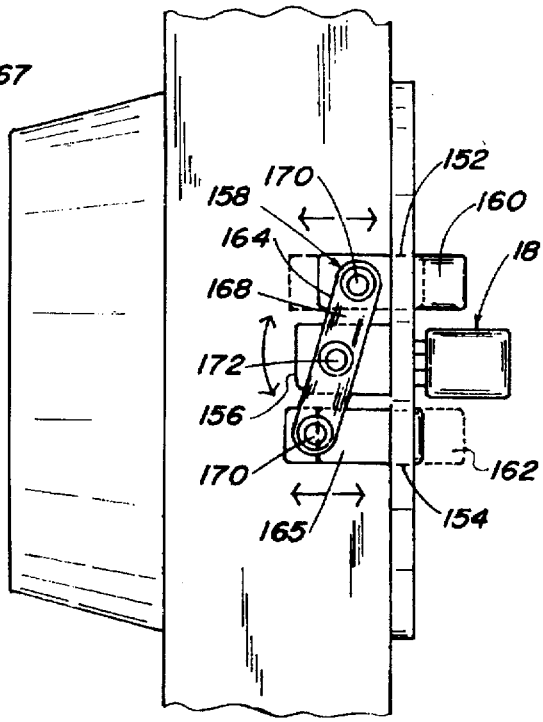
FIG. 2 is a side elevational view of the system shown in FIG. 1.

With reference now to the drawings, and in particular to FIGS. 1–3 thereof, the preferred embodiment of the new and improved security lock system embodying the principles and concepts of the present invention and generally designated by the reference numeral 150 will be described.

The present invention, the security lock system 150, is comprised of a plurality of components. Such components, in their broadest context, include a dead bolt lock and a C-shaped component. Such components are individually configured and correlated with respect to the other so as to attain the desired objective. More specifically, the present security lock system 150 includes a conventional dead bolt lock 12 in combination with a novel locking assembly as described hereinafter.

The dead bolt lock 12 is positionable in a door 14. Such lock includes a face plate 16 and a rotatable turn knob 18 to lock and unlock the door. The face plate and turn knob are conventional components of standard dead bolt locks and are located on the inside surface 20 of a door with a door knob beneath the dead bolt. The face plate is simply the conventional outer surface of the conventional dead bolt.

The dead bolt 12 lock may normally be locked and unlocked through a keyhole in the outside surface 22 of the door. The dead bolt lock is of the type having a dead bolt 24 operable in response to rotation of the turn knob on the inside of the door or in response to a key from the outside of the door. The turn knob extends outwardly from the interior surface of the door and the face plate. The face plate has a first aperture 152 extending through it above the turn knob, and a second aperture 154 extending through it below the turn knob 18. A planar member 156 is affixed to the face plate and extends within the dead bolt lock opposite from the turn knob. The planar member includes a circular hole extending through it. Note FIG. 2.

The turn knob is formed with an exterior surface having an upper planar side edge 26 and a lower planar side edge 28. Such edges are positionable in a generally horizontal position when the turn knob is rotated into a locked position. Note FIGS. 1 and 2. The side edges are positionable in a generally vertical orientation when the turn knob is rotated into an unlocked position. The rotational orientation of the edges may vary by 90 degrees in some dead bolt locks.

A generally C-shaped component 158 includes a first horizontal bar 160 and a second horizontal bar 162. Each bar is fabricated in a generally cylindrical configuration and has an inboard end 164, 165 and an outboard end 166, 167. The inboard end of each bar includes a circular hole extending through it. A vertical bar 168 includes an upper end, a lower end and a center point. The center point and each end of the vertical bar includes a circular hole extending through it. The first and second horizontal bars are pivotally coupled in a generally perpendicular orientation to the upper and lower ends of the vertical bar, respectively, by pivot pins 170 coupled through the aligned circular holes of the horizontal and vertical bars. The vertical bar is pivotally coupled to the planar member by a pivot pin 172 coupled through the aligned central hole of the vertical bar and circular hole of the planar member. When the horizontal bars are depressed by a user the coupling angle of the vertical bar with respect to the horizontal bars varies between 60 and 120 degrees. Note FIG. 2.

The outboard end 166, 167 of the first and second horizontal bars 160, 162 extend through the apertures 152, 154 of the face plate adjacent to the turn knob. Note FIG. 3. When the turn knob is positioned in a locked orientation a user depresses the outboard end of the second horizontal bar thereby causing the second horizontal bar to pivot inwardly. This action causes the vertical bar to pivot the first horizontal bar outwardly above the turn knob. When in this position the first horizontal bar 160 precludes rotation of the turn knob in a counter clockwise direction. Note FIGS. 2 and 3.

Therefore, to permit rotation of the turn knob in a counter clockwise direction to unlock the dead bolt a user depresses the outboard end 166 of the first horizontal bar thereby causing the first horizontal bar to move inwardly. This action causes the upper end of the vertical bar to pivot rearwardly thereby causing the second horizontal bar to pivot outwardly below the turn knob. The turn bar may then be rotated in a counter clockwise direction without obstruction by the first horizontal bar. If the user chooses to secure the turn knob in an unlocked orientation the second horizontal bar is depressed causing the first horizontal bar to project outwardly thereby precluding clockwise rotation of the turn knob. Note FIGS. 1–3.

The first alternative embodiment of the security lock system 10 is illustrated in FIGS. 4–7. The various components of such embodiment, in their broadest context, include a dead bolt lock, a horseshoe-shaped bar component, a projection, a hinge pin, and a thumb piece. Such components are individually configured and correlated with respect to the other so as to attain the desired objective. More specifically, the present security lock system 10 includes a conventional dead bolt lock 12 in combination with a novel locking assembly as described hereinafter.

Next provided as part of the system is the locking assembly 32. The locking assembly has as its central component a horseshoe-shaped bar component 34. Such bar component has an upper or first bar 36 and a lower or second bar 38. Each of the bars is provided with a horizontal interior edge 40. Such edges are parallel or essentially parallel with respect to each other. A vertical bar 42 is perpendicularly coupled between the first and second bars. The interior horizontal edges and vertical bar form a rectangular shaped open exterior end 44 and a closed interior end 46. The interior edges 40 of the upper and lower bars are spaced a distance so as to receive therebetween the upper and lower planar side edges 26 and 28 of the turn knob 18. Minimum space is intended to be created therebetween to make for a more secure locking relationship. The closed interior end 46 includes a central horizontal extension member 48. Such bar 48 extends in a direction away from the exterior end 44. Such central horizontal extension member is formed with a vertical aperture 50 extending therethrough.

The upper and lower bars 36 and 38 are formed with a plurality of holes 54 with horizontal axes extending therethrough. The purpose of such holes is for weight reduction to minimize the cost of the assembly. The upper bar 36 is also formed with a generally vertically extended threaded aperture 56. The purpose of such threaded aperture will be described hereinafter.

Coupling of the horseshoe-shaped bar component to the face plate is effected through a projection 60. Such projection is formed of two spaced halves with aligned cylindrical interior bearing surfaces which are secured to the face plate and extend outwardly therefrom at a horizontal height which generally corresponds to that of the turn knob when in the horizontal locked position. The projections 60 are positioned on the lateral sides of the face plate 16 remote from the dead bolt 24 and are formed with aligned vertical apertures 62 extending therethrough.

A hinge pin 66 is next provided to complete the coupling. Such hinge pin extends through the vertical apertures 50 and 62 of the spaced projections and the horizontal bar. Such hinge pin creates a vertical pivot point for the rotation of the horseshoe-shaped bar component between its opened and closed positions.

Lastly provided is a thumb piece 70. Such thumb piece has at its lower extent 72 a threaded exterior surface in a cylindrical shape. At its upper extent 74 is a spherically shaped knurled ball 76. The thumb piece is positioned in a generally vertical position with its threaded lower extent 72 rotatably secured within the threaded aperture 56 of the upper bar. The axis of the thumb piece is at an angle slightly offset from the vertical. Note FIG. 6. In this manner, the upper end of the thumb piece extends outwardly from the face plate and the door when the horseshoe-shaped bar component is in the locked position. Such angled position allows a user to more easily grasp the thumb piece to effect its rotation for locking and unlocking of the horseshoe-shaped bar component with respect to the turn knob.

Figure 8:
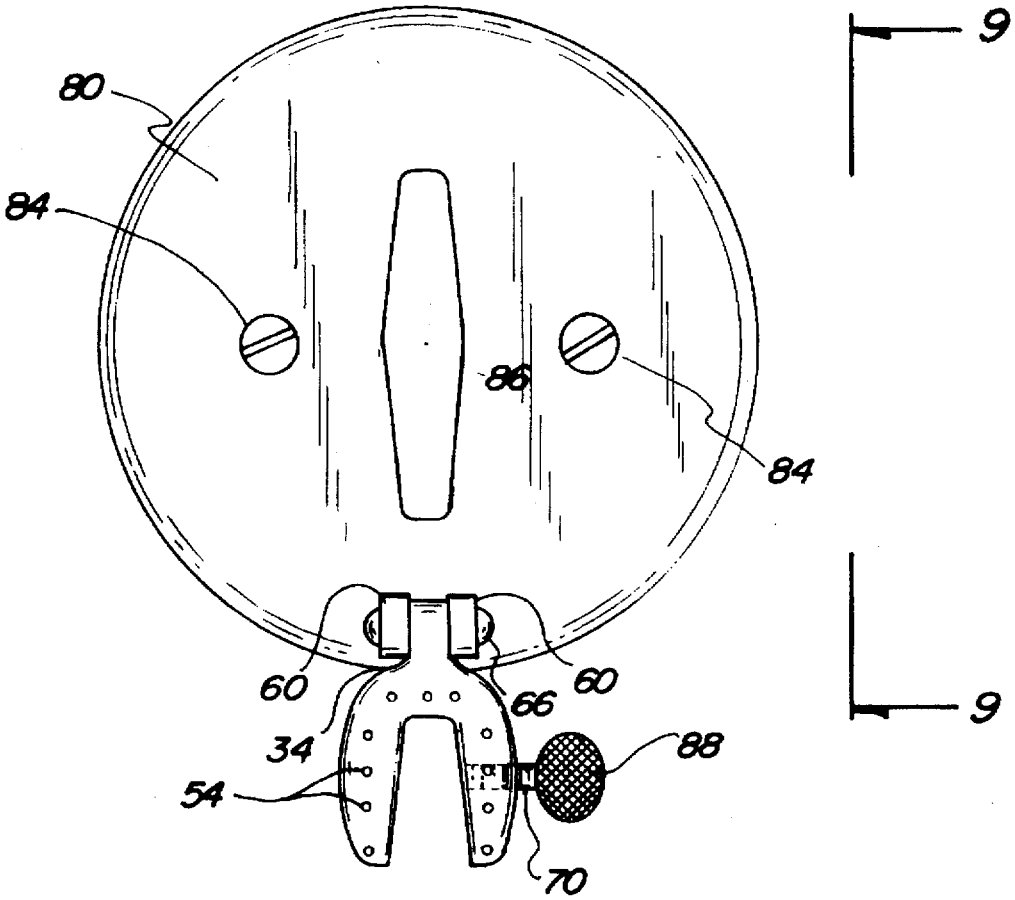
FIG. 8 is a front elevational view of a locking assembly similar to FIG. 4 but illustrating the second alternate embodiment of the invention.
Figure 9:
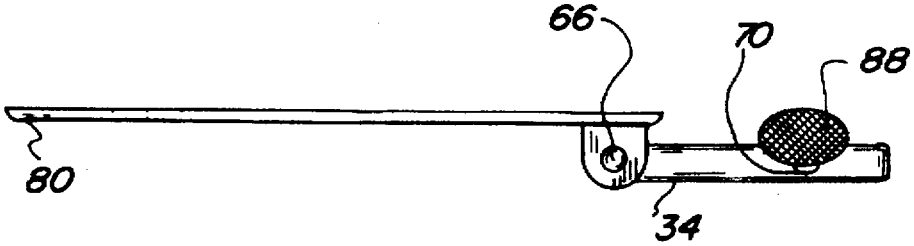
FIG. 9 is an end elevational view of the assembly of FIG. 8 taken along line 9—9 of FIG. 8.

A second alternate embodiment of the apparatus is shown in FIGS. 8 and 9. In such alternate embodiment, the components are essentially the same as that described in the first alternate embodiment. The face plate 16, however, is not formed as a part of the dead bolt lock 12. In the first alternate embodiment of FIGS. 4 through 7 it is intended that the consumer purchase the dead bolt lock 12 with the locking assembly 32 formed integrally therewith. In the second alternate embodiment of FIGS. 8 and 9, the intended purchaser is one who already has a dead bolt lock but who desires to attach thereto a locking assembly 32. Such assembly 32 would include a separate face plate 80 and the other components of the locking assembly as in the first alternate embodiment for being secured to the existing dead bolt lock through the bolts 84 and central hole 86 for the turn knob normally a part of conventional dead bolt locks. Securement of the separate face plate to the dead bolt may also be effected by an adhesive, welding, a threaded fastener or fasteners or the like.

The knurled ball 76 of the first alternate embodiment may be used for grasping and pulling the door open or pushing the door closed when the dead bolt is retracted. In the first embodiment, such ball 76 is of a spherical configuration. In the alternate embodiment, the ball is replaced by a flat disk 88, again with a knurled surface for ease of grasping. Such upper components of the front piece are readily interchangeable as a function of the preference of a user. In both embodiments, all components of the system are preferably fabricated of a strong material such as a high-carbon steel to add to maximum security to the system.

The second alternate embodiment of the apparatus is illustrated in FIGS. 8 and 9. The second alternate embodiment is a slight modification of the first alternate embodiment as described above. In the second alternate embodiment the orientation of the hinge pin for the horseshoe-shaped bar component is horizontal. In contrast, the axis of rotation of the first alternate embodiment is vertical, as shown in FIGS. 4 through 7. In the second alternate embodiment the horseshoe-shaped bar component is pivotable downwardly rather than to the side. In either embodiment, the device functions in a similar manner one with respect to another.

Further, although the first alternate embodiment shows the turn knob as having parallel sides, the second alternate embodiment shows such sides as being angled. In either embodiment, it is preferred that the interior faces of the horseshoe-shaped bar component be configured to be essentially parallel to the adjacent edges of the turn-knob. It is adapted to contact and restrain the turn knob from motion.

Figure 11:
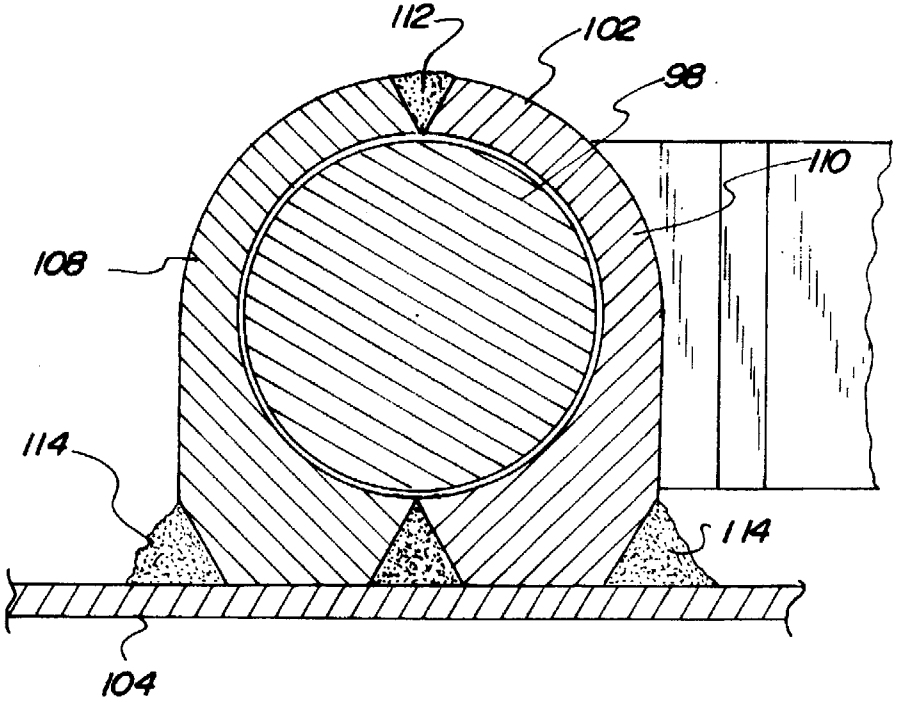
FIG. 11 is a cross sectional view taken along line 11—11 of FIG. 10.
Figure 10:
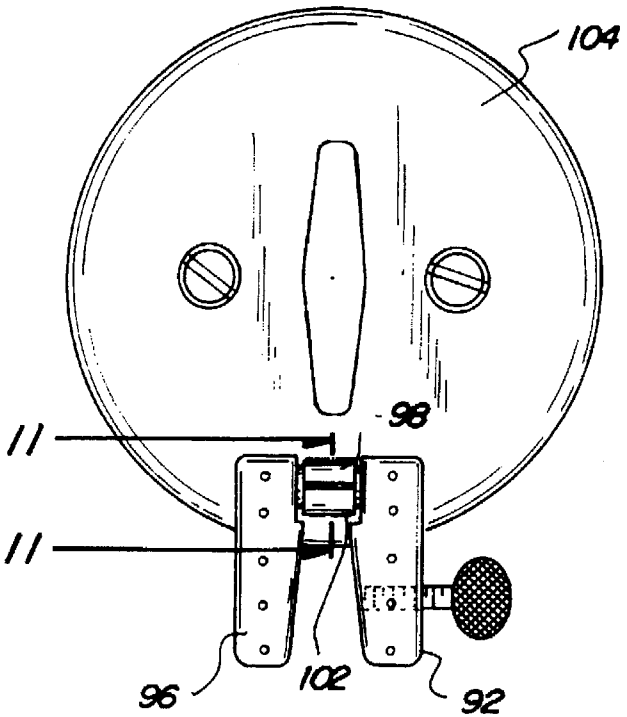
FIG. 10 is a front elevational view similar to FIG. 8 but illustrating the third alternate embodiment of the invention.
Figure 12:
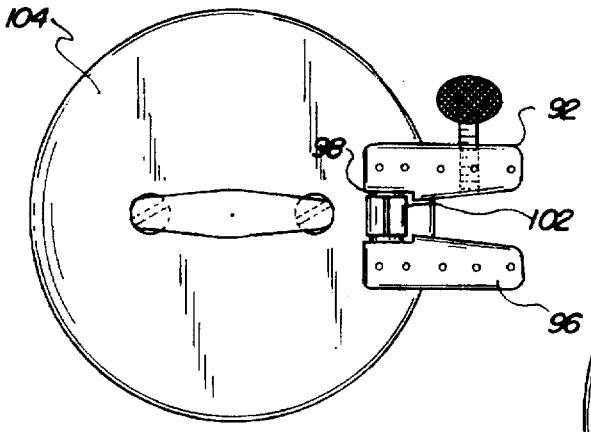
FIG. 12 is a front elevational view similar to FIG. 10 but with the components turned 90 degrees.

The third alternate embodiment of the invention is shown in FIGS. 10 and 11. In such embodiment, the horseshoe-shaped bar component 92 is again stylized to be configured in the general shape of a horseshoe. It is provided with first and second legs 96 having internal edges preferably adapted to conform to the shape of the adjacent edges of the turn knob. A cross piece 98 couples the legs 96. The cross piece 98, however, constitutes a bridge with a cylindrical configuration having a circular cross section. Note FIG. 11. As such, a part of the horseshoe-shaped bar component thus forms the pivot pin. Such pivot pin is constrained for rotational motion within a projection 102 which is mounted on the base plate 104. Such projection is formed in two halves 108 and 110 split along the axis to allow the pivot pin to be inserted therein for the intended rotational motion. The projection is split radially for the positioning of the pivot pin therewithin. Welding 112 at the upper and lower edges secure the two halves of the projection together with the pivot pin therein with additional welding 114 at the lower side edges securing such pivot pin and legs 96 to the base plate 104. The operation of the device is essentially the same as that in the prior embodiments and could be used with facing edges of the legs parallel with respect to each other wherein the turn knob has parallel lateral edges. Similarly, the pivot pin could be adapted for rotation about a horizontal axis as shown or about a vertical axis as in the first alternate embodiment. Lastly, this third alternate embodiment could be utilized in association with the attachment plate 104 as in the second alternate embodiment for coupling to an existing dead bolt lock or, it could be coupled directly to the face plate constituting the exposed exterior surface of a dead bolt system bought with such supplemental security lock components being as shown in FIGS. 10 and 11 as well as 8 and 9.

Figure 13:
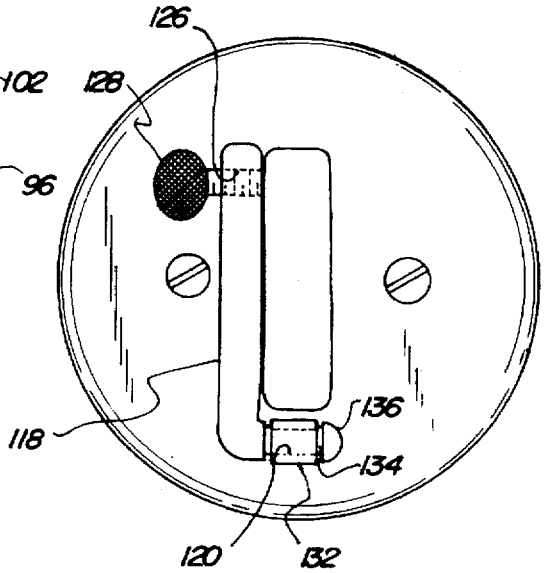
FIG. 13 is a front elevational view illustrating a fourth alternate embodiment of the invention.

FIG. 13 shows a fourth embodiment of the invention. In such embodiment, the face plate may either be formed integrally with, or adapted to be coupled with respect to, the dead bolt. The bar component, however, is formed as a single elongated bar component 118 which has first end and a second end. A hinge pin 120 is formed integrally with the second end of the bar and extends at a ninety degree angle with respect to the bar component. The hinge pin has a circular cross sectional configuration and is adapted to function as a pivot point. Such hinge pin 120 is received in a projection formed as a cylindrical tube 122 secured with respect to the face plate. An enlargement 124 at the end of a reduced diameter extent at the center of the hinge pin ensures its retention within the tube. The bar component 118 is of a greater length than that of the prior embodiments, essentially the same length as the turn knob. It has a threaded aperture 126 extending therethrough adjacent to its first end. Such aperture is adapted to receive the threaded end of the thumb piece 128. When rotated and threaded outwardly from the bar component 118, the bar component 118 may pivot about its pivot point to the position as shown in FIG. 13 for locking purposes upon screwing in of the thumb piece to contact the turn knob. The long leg may also be pivoted downwardly about its pivot point to allow for free rotation of the turn piece 130 in either direction. When in the position as shown in FIG. 13, the thumb piece may be screwed in whereby it comes into contact with the turn knob to preclude rotation of the turn knob to the unlocked position. Rotation of the thumb piece away from the turn knob will allow its movement away from the turn knob so that only then may the bar component 118 be pivoted away from the turn knob to thereby allow the free locking and unlocking of the dead bolt.

Figure 14:
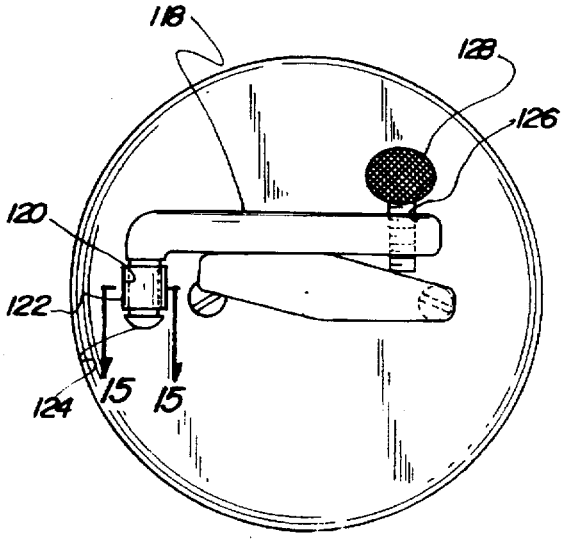
FIG. 14 is a front elevational view similar to FIG. 13 but illustrating a different orientation of such embodiment.
Figure 15:
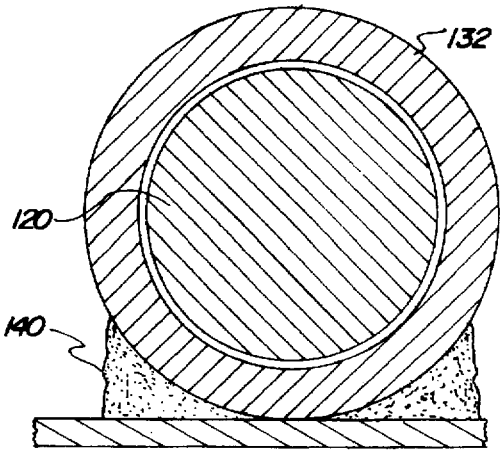
FIG. 15 is a cross sectional view taken along line 15—15 of FIG. 14.

FIGS. 14 and 15 illustrate a variation of the fourth alternate embodiment of FIG. 13. In the FIG. 14 embodiment, all the components as utilized in the FIG. 13 embodiment continue to be utilized in essentially the same manner. The only difference is that the axis of rotation is turned ninety degrees so as to be in a vertical orientation to allow for the horizontal swinging of the long component or leg 118. A cross sectional view is taken along line 15—15 of FIG. 14 to illustrate the coupling between the hinge pin 120 and a modified tube 132. In such embodiment, the tube is formed of a one-piece component to receive a central extent 134 of the leg of the hinge pin 120. The end of the hinge pin 120 is then formed with an enlargement 136 in a manner similar to a rivet for retaining the hinge pin in its position for rotation within the tube. The tube is then welded in position on the face plate through welding material 140.

The present invention, therefore, is a dead bolt lock system and related assembly of parts designed to include added security components which fit over the interior turn knob of a dead bolt lock to lock or freeze it in position and prevent anyone from unlocking it from the outside.

The present invention is designed essentially the same as a conventional dead bolt lock having an interior turn knob. What differs is a horseshoe-shaped bar component pivotally mounted onto the surface of the lock face plate and designed to swing into locking engagement over the turn knob when the dead bolt is in the locked position.

After turning the dead bolt turn knob to position the dead bolt into an extended locked position, the horseshoe-shaped bar component is swung over the turn knob, thereby securing it in place. The thumb piece is then screwed down to further prevent anyone from unlocking the turn knob from the outside, even if they have the key. By unscrewing the thumb piece and pivoting the horseshoe-shaped bar component away from the turn knob, the turn knob is free to be rotated by turning the turn knob from the inside or by using a key from the outside.

The present invention provides added security to occupants by preventing anyone from unlocking a dead bolt lock from the outside of a door. Intruders are effectively locked out of a dwelling or other place so equipped.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A security device for blocking the unlocking of a dead-bolt, the device comprising;

a face plate and a rotatable mm knob located on an exterior side of the face plate, the face plate being adapted to be positioned on an interior face of a door to allow the turn knob to be hand operated with the door in a closed position, the turn knob having locked and unlocked positions, wherein the mm knob is adapted for operating the dead-bolt between corresponding locked and unlocked positions, the faceplate also having first and second apertures extending therethrough, the apertures located on opposite sides of the turn knob, the turn knob having a substantially bar-shaped exterior portion adapted for operation by hand and an interior portion extending through the face plate for connection to the dead-bolt, a turn knob blocking mechanism comprising;

a fulcrum bar having a near end affixed to an interior side of the face plate opposite the turn knob, a generally C-shaped linkage composed of first and second parallel laterally spaced bars and a third intermediate bar that is substantially perpendicular to the first and second bars, the first and second bars each being pivotally connected at a near end to opposite ends of the intermediate bar, the first and second bars also having far ends positioned adjacent a corresponding one of the first and second apertures of the face plate, the intermediate bar being pivotally connected at a substantially center portion to a far end of the fulcrum bar thereby allowing rotation of the intermediate bar such that the far end of one or the other first and second bars can be alternatively projected outwards through the corresponding one of the first and second apertures of the faceplate, the C-shaped linkage being arranged for pivoting between two extreme positions;

a first unblocking position, wherein the far end of one of the first and second bars is projected outwards of its corresponding aperture and the far end of the other of the first and second bars is substantially flush with the exterior surface of the face plate such that the turn knob is free to be rotated between its locked and unlocked positions, and a blocking position which is achieved by hand pressing the far end of the projecting bar into a second position that is substantially flush with the exterior surface of the face plate, thereby rotating the intermediate bar about its connection to the fulcrum bar and causing the far end of the other of the first and second bars to be projected outwards of its corresponding aperture into a position which is adapted to contact the exterior portion of the turn knob to block rotation of the turn knob to its unlocked position, thereby preventing the dead-bolt from being unlocked, the C-shaped linkage being returned to its unblocked position by hand pressing the far end of the projecting bar to a position that is substantially flush with the faceplate, thereby reversing rotation of the intermediate bar.

* * * * *